US008375518B2

(12) United States Patent
Haemmerle

(10) Patent No.: US 8,375,518 B2
(45) Date of Patent: Feb. 19, 2013

(54) FURNITURE HINGE WITH ROTATION DAMPER

(75) Inventor: Claus Haemmerle, Lustenau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/116,335

(22) Filed: May 26, 2011

(65) Prior Publication Data

US 2011/0225768 A1 Sep. 22, 2011

Related U.S. Application Data

(63) Continuation of application No. PCT/AT2009/000409, filed on Oct. 20, 2009.

(30) Foreign Application Priority Data

Dec. 17, 2008 (AT) ..... A 1967/2008

(51) Int. Cl.
*E05F 1/08* (2006.01)

(52) U.S. Cl. ..... 16/286; 16/50

(58) Field of Classification Search ..... 16/286–288, 16/302, 370, 49, 50, 82, DIG. 17, DIG. 21, 16/54

See application file for complete search history.

(56) References Cited

U.S. PATENT DOCUMENTS

| | | | | |
|---|---|---|---|---|
| 7,275,284 | B2 * | 10/2007 | Lautenschlager et al. | 16/287 |
| 7,562,416 | B2 * | 7/2009 | Lautenschlager et al. | 16/286 |
| 7,600,295 | B2 * | 10/2009 | Zimmer | 16/286 |
| 7,669,285 | B2 * | 3/2010 | Gallasch et al. | 16/286 |
| 7,712,185 | B2 * | 5/2010 | Pyo | 16/286 |
| 7,748,082 | B2 * | 7/2010 | Harald et al. | 16/286 |
| 7,861,376 | B2 * | 1/2011 | Fitz et al. | 16/286 |
| 7,874,043 | B2 * | 1/2011 | Salice | 16/286 |
| 7,886,408 | B2 * | 2/2011 | Lautenschlager | 16/286 |
| 7,900,321 | B2 * | 3/2011 | Fitz et al. | 16/362 |
| 7,966,696 | B2 * | 6/2011 | Krammer | 16/286 |
| 2007/0220705 | A1 | 9/2007 | Fitz et al. | |
| 2007/0251058 | A1 | 11/2007 | Fitz et al. | |
| 2008/0172834 | A1 * | 7/2008 | Sutterlutti | 16/286 |
| 2008/0209674 | A1 * | 9/2008 | Harald et al. | 16/82 |

FOREIGN PATENT DOCUMENTS

| | | |
|---|---|---|
| AT | 410 118 | 2/2003 |
| DE | 201 21 164 | 6/2002 |
| DE | 20 2004 016 396 | 2/2005 |
| EP | 1 199 433 | 4/2002 |
| EP | 1 538 293 | 6/2005 |
| WO | 2006/053364 | 5/2006 |
| WO | 2008/011955 | 1/2008 |
| WO | 2008/077520 | 7/2008 |

OTHER PUBLICATIONS

International Search Report issued Sep. 17, 2010 in International (PCT) Application No. PCT/AT2009/000409.
Austrian Patent Office Search Report issued Apr. 21, 2009 in corresponding Austrian Patent Application No. A 1967/2008.

* cited by examiner

*Primary Examiner* — William L. Miller
(74) *Attorney, Agent, or Firm* — Wenderoth, Lind & Ponack, L.L.P.

(57) ABSTRACT

A furniture hinge has at least two fitting parts for fixing the hinge to furniture parts. One of the fitting parts is designed as a hinge arm with at least one joint lever which pivots during the hinge movement and a rotation damper for damping a hinge movement. A slide, movably mounted on the hinge arm, may be driven by the pivotable joint lever, and the slide acts on the rotation damper by means of a transmission mechanism (T).

17 Claims, 10 Drawing Sheets

FURNITURE HINGE WITH ROTATION DAMPER

Figure 1:
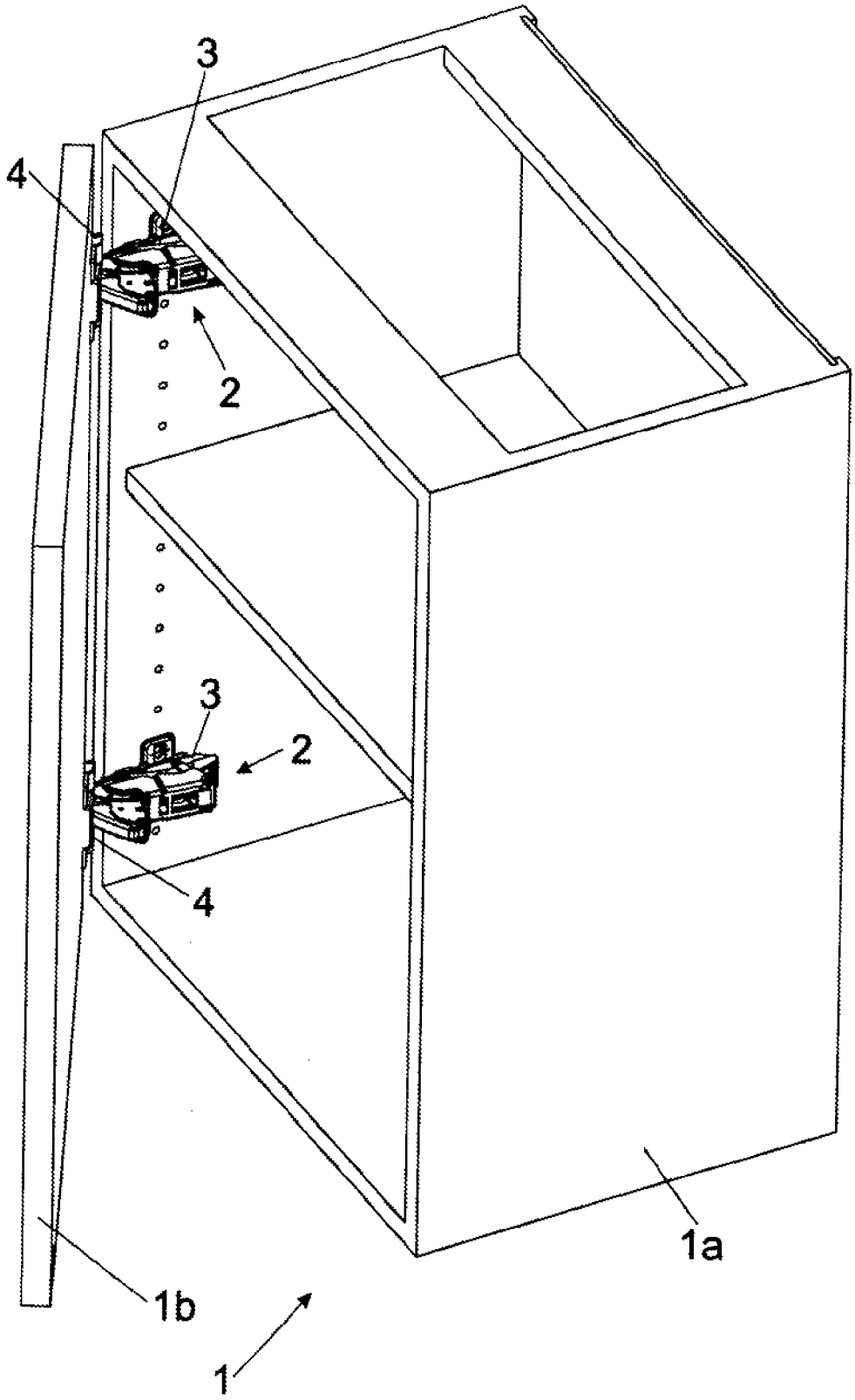

This application is a Continuation of International application No. PCT/AT2009/000409, filed Oct. 20, 2009, the entire disclosure of which is incorporated herein by reference.

BACKGROUND OF THE INVENTION

The present invention relates to a furniture hinge comprising at least two fitment parts for fixing to furniture parts, wherein one of the fitment parts is in the form of a hinge arm, at least one joint lever pivotable during the hinge movement, and a rotation damper for damping a hinge movement.

The invention further concerns an article of furniture comprising at least one furniture hinge of the kind to be described.

Rotation dampers for damping hinge movements are frequently in the form of a fluid damper having at least two damping components which—at least in the damping stroke—are arranged rotatably relative to each other. Provided between the two damping components is a space (preferably a shearing gap) with a damping fluid on which shearing forces act during the damping stroke, whereby a damping action can be generated. Rotation dampers usually have a travel-dependent damping function (i.e., the degree of damping is dependent on the rotary angle range covered by the two damping components relative to each other). Thus a certain damping travel has to be provided to achieve the desired soft damping effect. In practice, the fulfillment of those requirements repeatedly encounters limits which are predetermined by the geometry of the furniture hinge. Thus, it is often difficult for a rotation damper to be integrated into the furniture hinge in such a way that, on the one hand, damping begins at a given relative position of the fitment parts with respect to each other but, on the other hand, a sufficient rotary angle range of one damping component relative to the other is still covered.

SUMMARY OF THE INVENTION

It is therefore an object of the present invention to propose a furniture hinge of the general kind set forth in the opening part of this specification, wherein good damping results can be achieved even with large opening angles in respect of the furniture hinge.

In an advantageous configuration according to the invention, the object is achieved in that a slider mounted displaceably on the hinge arm is drivable by the pivotable joint lever and the slider acts on the rotation damper by way of a transmission mechanism.

The invention can be particularly desirably implemented in relation to wide-angle hinges having at least seven axes of rotation. In general, an opening angle which is greater than 90° is achieved with a wide-angle hinge. Frequently such wide-angle hinges have a maximum opening angle of between 170° and 180°. To increase the length of the hinge arm, wide-angle hinges are frequently provided with intermediate portions which are arranged movably by way of joint levers between the actual fitment parts (the hinge arm and the hinge cup respectively). Now, use is made of those joint levers which are pivoted during the hinge movement to provide that at least one of those joint levers is used to act on the slider which is mounted on the hinge arm and is displaceable during the damping stroke relative to the hinge arm—preferably with a translatory movement. That linear movement of the slider is transmitted to the rotation damper by way of a transmission mechanism (for example a rack-pinion arrangement), whereby an opening and/or closing movement of the furniture hinge can be dampened. In that respect, the transmission mechanism can have a transmission ratio by which a pivotal angle movement covered by the joint lever can be stepped up to a higher rotary angle range of the rotation damper. Thus, a relatively small pivotal movement of the joint lever is already enough to trigger a correspondingly higher rotary movement of the rotation damper so as to ensure adequate shearing of the damping fluid between the two damping components of the rotation damper.

In a possible embodiment of the invention, the slider can be separate from the joint lever, and the slider can be acted upon by the joint lever only as from a predetermined relative position of the fitment parts with respect to each other. In other words, therefore there does not have to be positive coupling of the rotation damper. The joint lever is therefore movable independently of the slider over the great part of the pivotal movement of the joint lever and it acts on the slider only as from a predetermined relative position of the fitment parts with respect to each other. The slider acts on the joint lever by pure contacting, that is to say during the damping stroke the joint lever bears only loosely against the slider, whereas in the opening movement the joint lever can immediately lift off the slider so that the furniture hinge is movable into the completely open position independently of the rotation damper.

In a possible configuration of the invention, the rotation damper can be mounted at that end of the hinge arm which is remote from the second fitment part. In the state of the art, it was hitherto usual for the rotation damper to be arranged admittedly on the hinge arm, but in the immediate proximity of a hinge axis connecting the two fitment parts. In the present invention, in contrast, the rotation damper can be arranged at the free end of the hinge arm, with overall more free space being available. In that case, the rotation damper can be arranged so that all components thereof (that is to say the rotation damper in its entirety), during the damping stroke, move relative to the hinge arm and also relative to the second fitment part (for example the hinge cup). In that way, the beginning, the progress, and the end of the damping procedure can be additionally influenced.

The article of furniture according to the invention is characterized by at least one furniture hinge of the kind described.

BRIEF DESCRIPTION OF THE INVENTION

Figure 2:
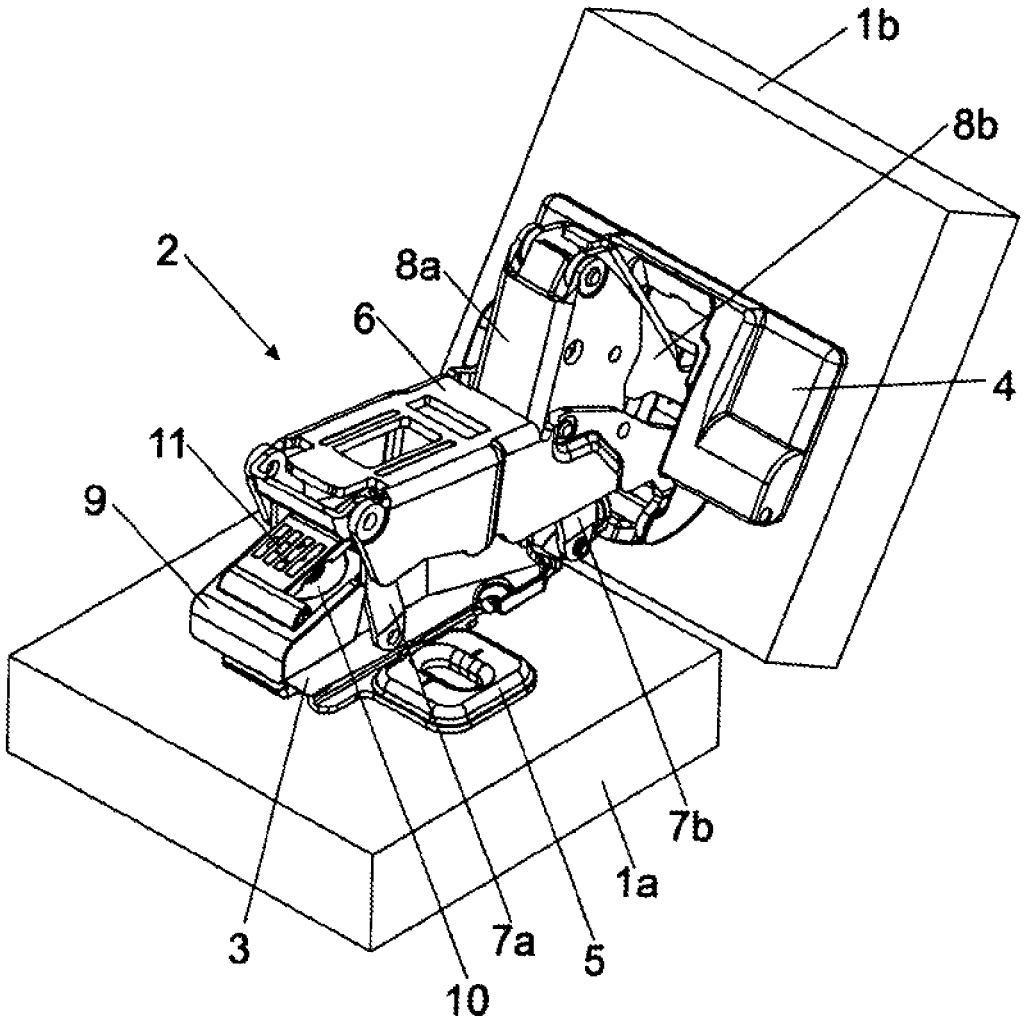
Figure 3A:
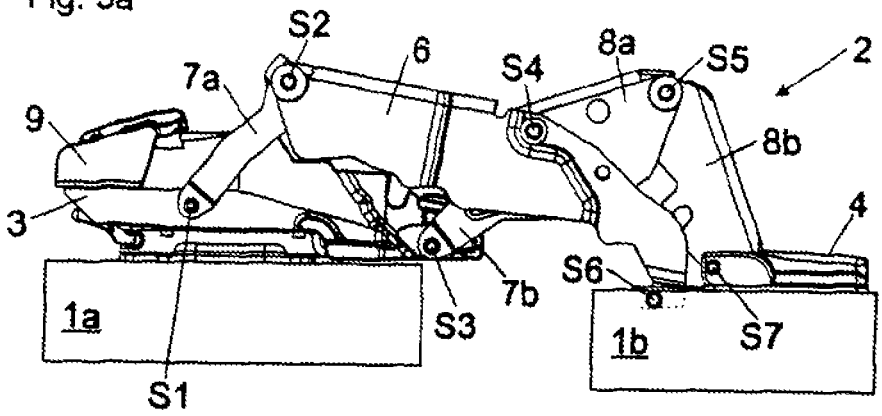
Figure 3B:
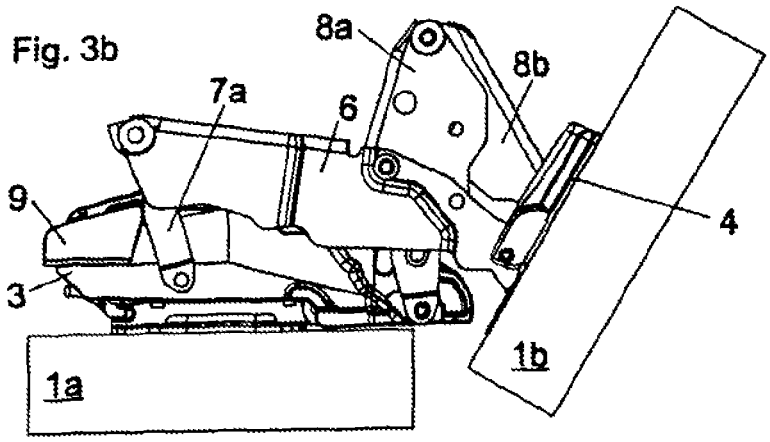
Figure 3C:
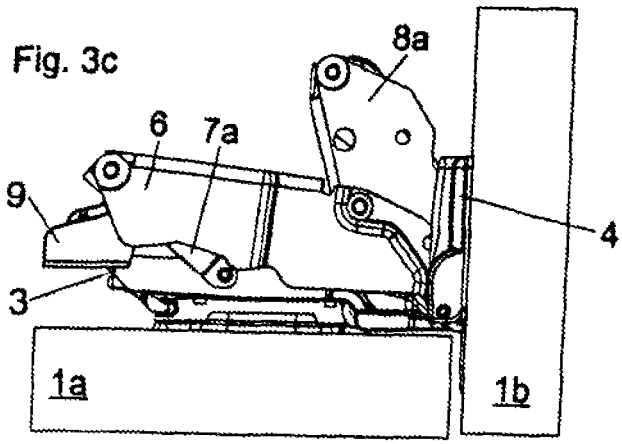
Figure 4A:
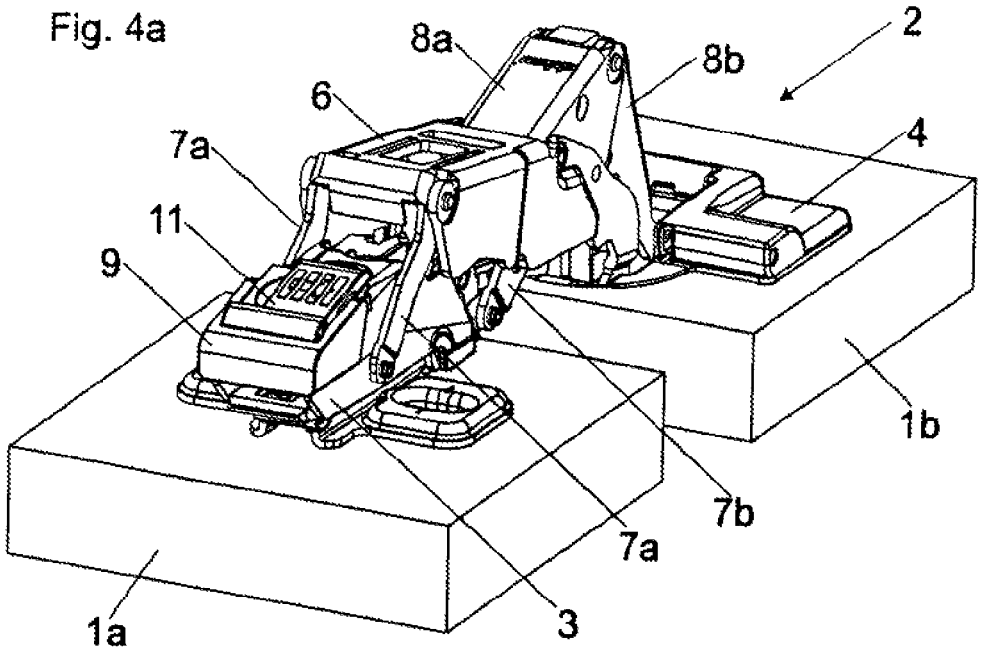
Figure 4B:
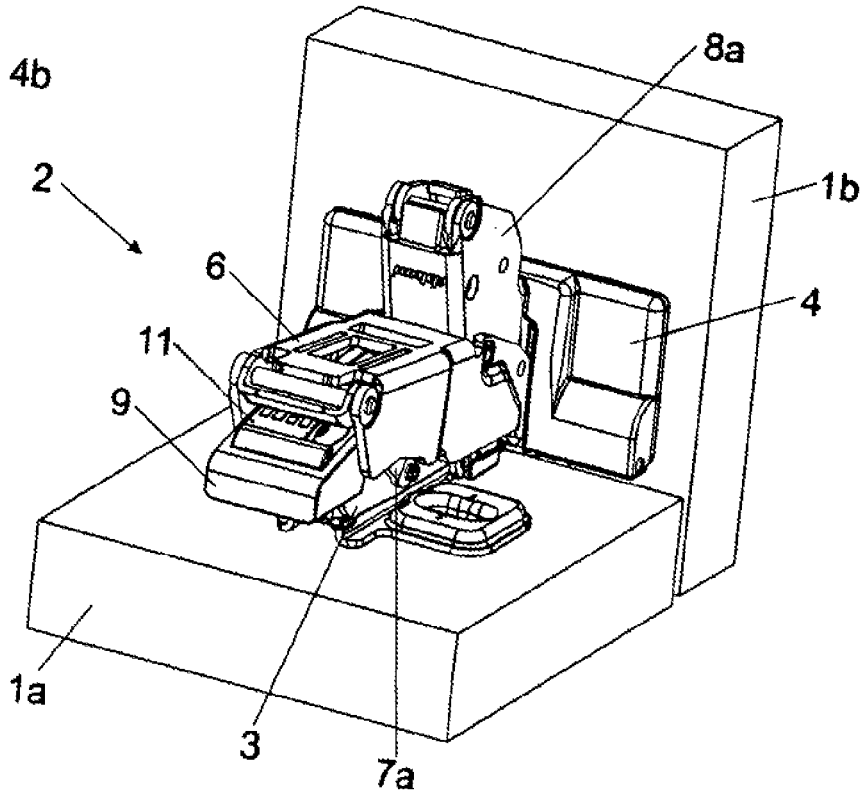
Figure 5A:
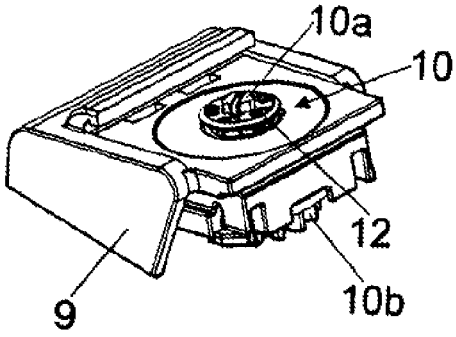
Figure 5B:
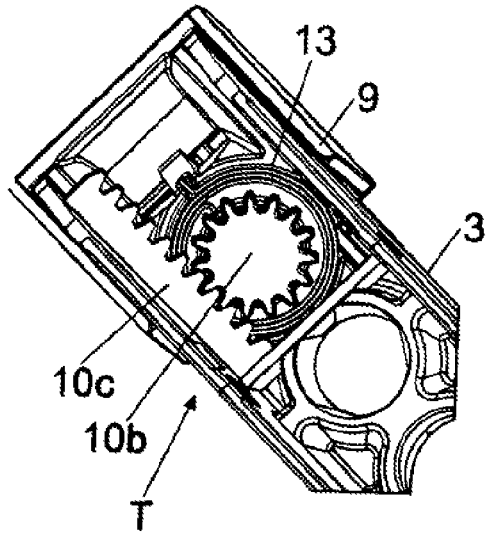
Figure 5C:
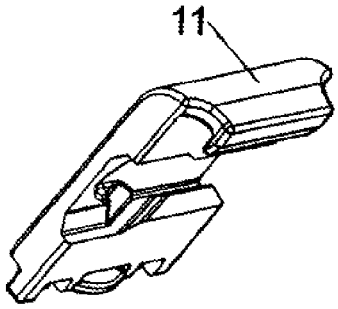
Figure 5D:
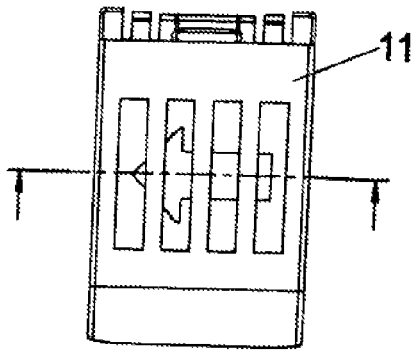
Figure 5E:
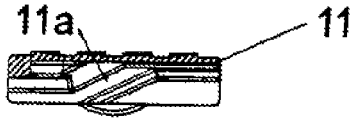
Figure 6:
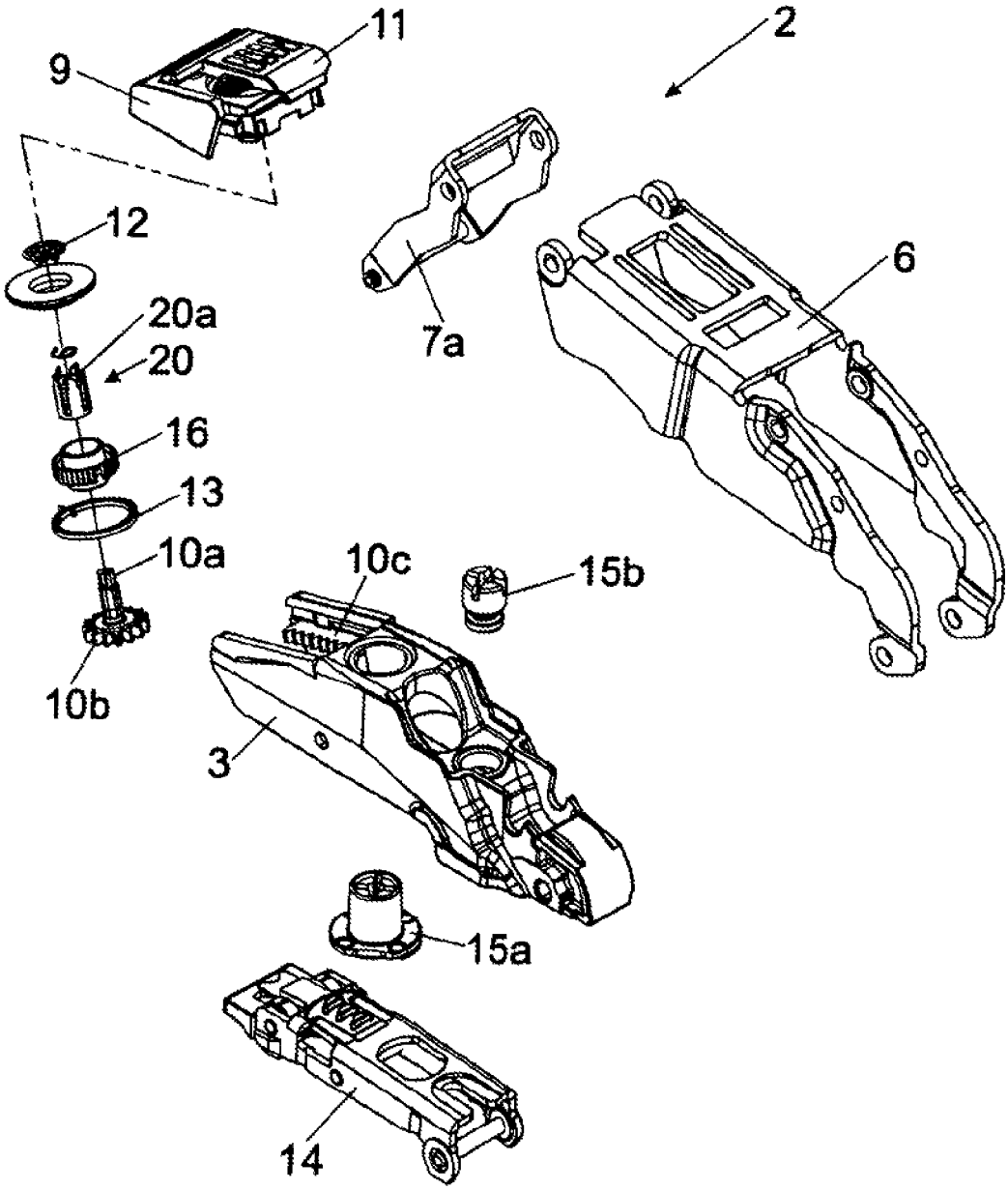
Figure 7A:
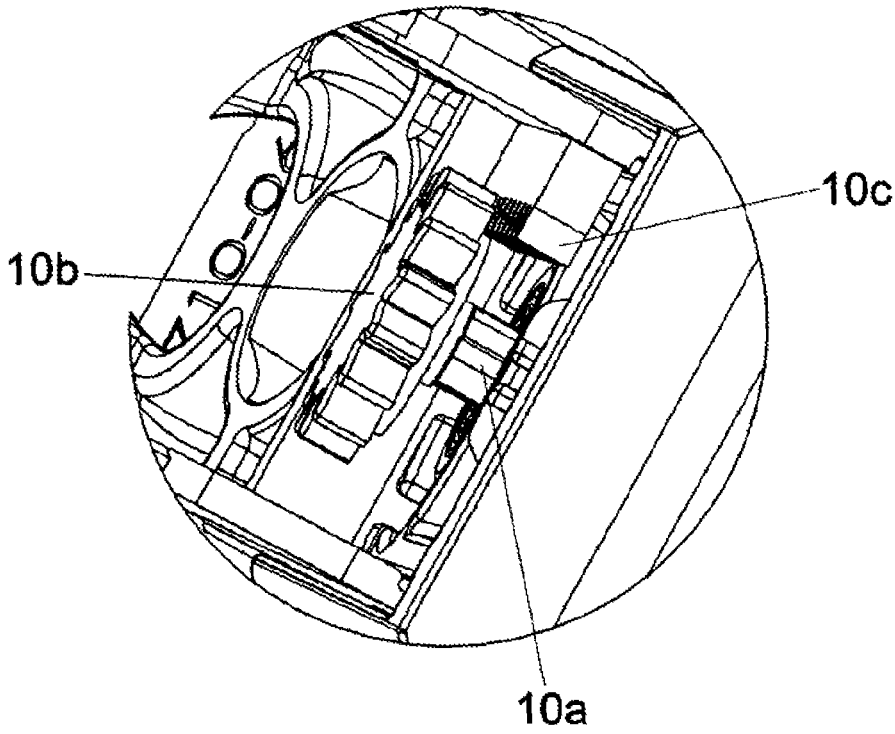
Figure 7B:
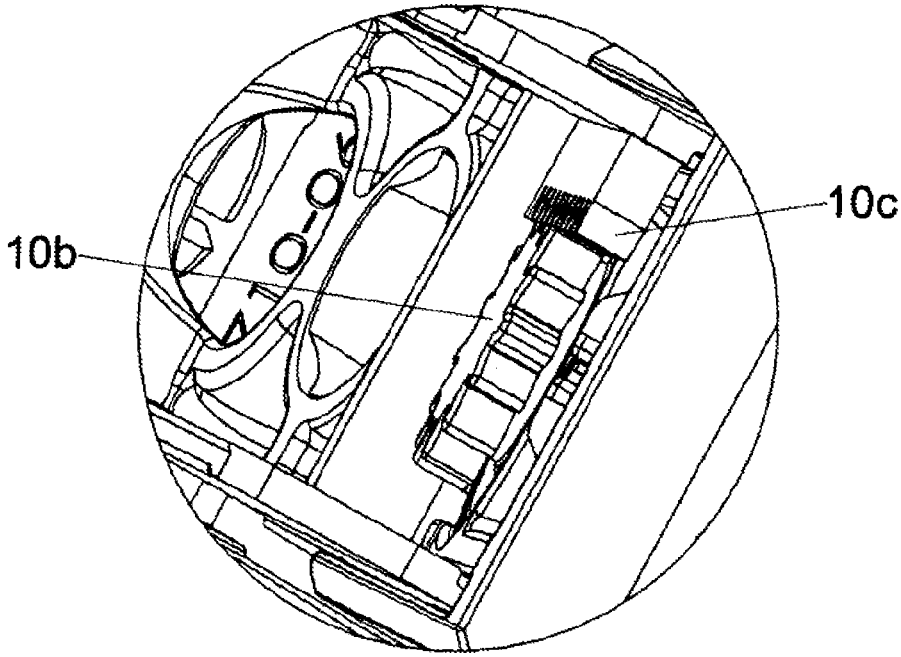
Figure 8A:
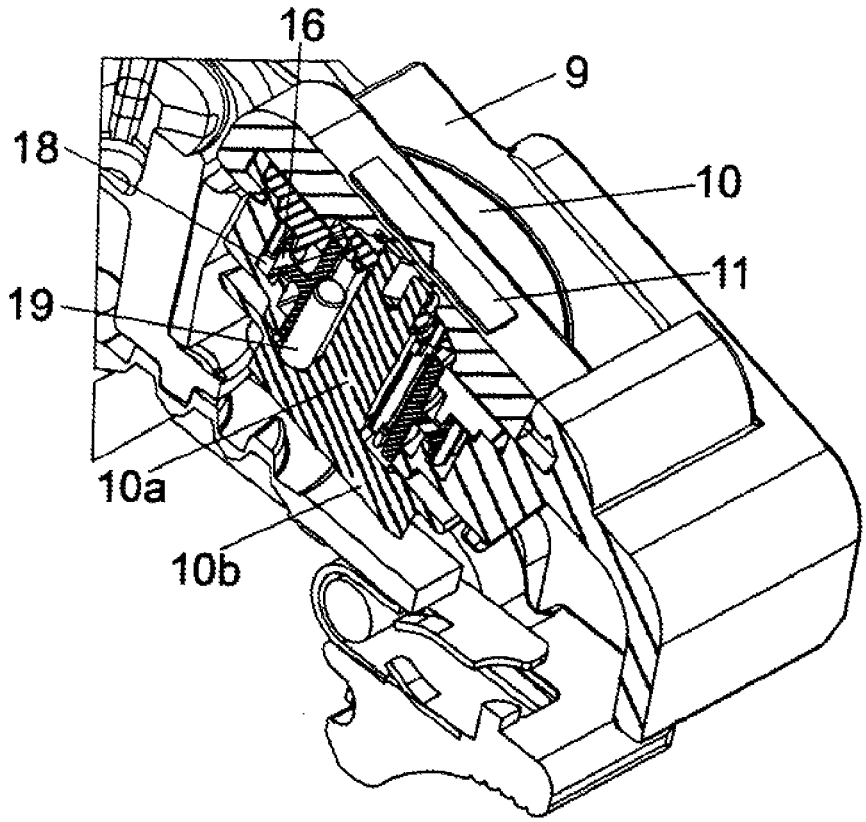
Figure 8B:
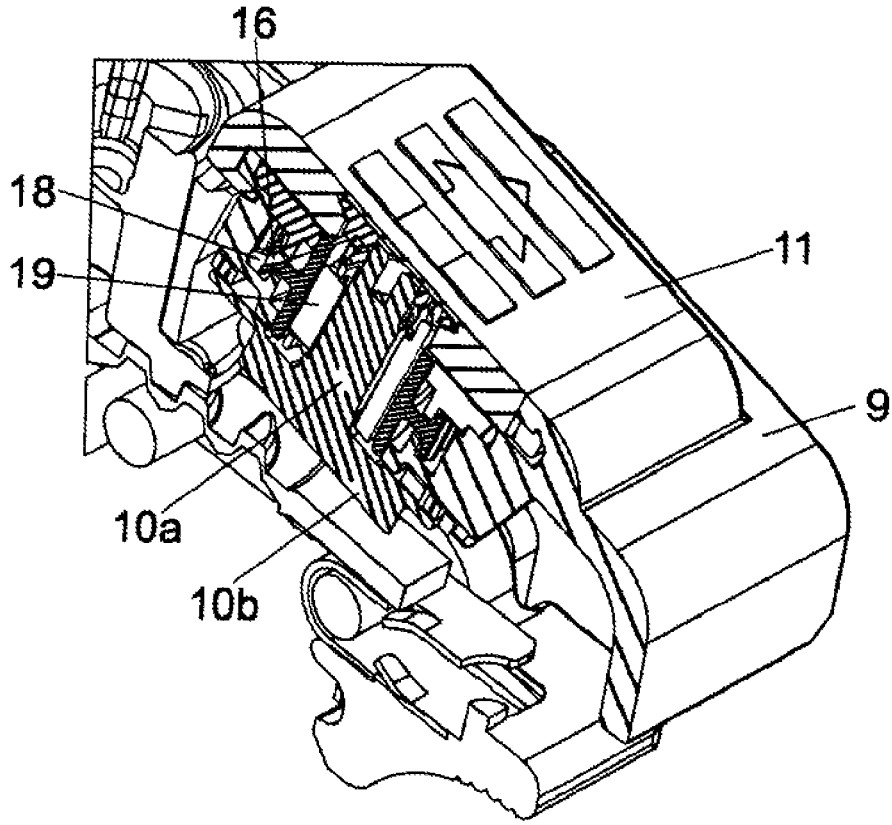

Further details and advantages of the present invention are described by means of the specific description hereinafter, in which:

FIG. 1 shows a perspective view of an article of furniture having a movable furniture part mounted pivotably relative to a furniture carcass by way of furniture hinges according to the invention, FIG. 2 shows a perspective view of the furniture hinge mounted to the furniture parts, FIGS. 3*a*-3*c* show side views of the furniture hinge in time successions of the damping process in the closing direction, FIGS. 4*a*, 4*b* show perspective views of the furniture hinge in an open position and FIGS. 5*a*-5*e* show various views of the linearly displaceable slider and the switching member for deactivation of the damping function of the furniture hinge, FIG. 6 shows an exploded view of the carcass-side part of the furniture hinge, FIGS. 7*a*, 7*b* show a possible embodiment for deactivation of the damping function of the furniture hinge, FIGS. 8*a*, 8*b* show perspective views in vertical section of the rotation damper, wherein the damping function of the furniture hinge can be switched on and off by the switching member, FIGS. 9*a*-9*d* show various positions of the switching knob which is displaceable by the switching member and enlarged detail views thereof, and FIGS. 10*a*-10*d* show various views of the selective coupling between the shaft and the damping component for activation and deactivation of the damping function of the furniture hinge and enlarged detail views thereof.

DETAILED DESCRIPTION OF THE INVENTION

FIG. 1 shows an article of furniture 1 in cabinet form having a furniture carcass 1*a* and a furniture part 1*b* which is pivotable relative thereto and which is mounted limitedly movably between a closed position and an open position by way of two furniture hinges 2 according to the invention. The furniture hinges 2 are preferably in the form of wide-angle hinges, that is to say the movable furniture part 1*b* can assume an opening angle of more than 90° relative to the front face of the furniture carcass 1*a*. The furniture hinges 2 have fitment parts in the form of a hinge arm 3 and a hinge cup 4 respectively, which is recessed in a bore in the movable furniture part 1*b*.

FIG. 2 shows a perspective view of the furniture hinge 2, the hinge arm 3 of which can be releasably latched to a mounting plate 5 known from the state of the art. In the illustrated embodiment, the second fitment part is in the form of a hinge cup 4 provided for connection to the movable furniture part 1*b*. An intermediate portion 6 is positively guided by way of two pivotable joint levers 7*a*, 7*b* relative to the hinge arm 3. Pivotally connected to the intermediate portion 6 is an intermediate lever 8*a* which is hingedly connected to the hinge cup 4 by way of a further intermediate lever 8*b*. What is of particular significance is a movable slider 9 which is mounted at the free rear end of the hinge arm 3 and which is linearly displaceable at least during the damping stroke, relative to the hinge arm 3. The pivotable joint lever 7*a* is provided for acting on the slider 9 which in the course of the closing movement of the furniture hinge 2 is urged into a rear end position by the joint lever 7*a* only as from a predetermined relative position of the hinge cup 4 with respect to the hinge arm 3. A rotation damper 10 mounted on the slider 9 (or also on the hinge arm 3) is drivable by that triggered linear movement of the slider 9. Provided for selectively switching the damping function of the rotation damper 10 on and off is a switching member 11 which is displaceable transversely with respect to a longitudinal axis of the hinge arm 3.

FIGS. 3*a*-3*c* show side views of the furniture hinge 2 in time successions of the damping process in the direction of the closed position. FIG. 3*a* shows an open position of the furniture hinge 2. The furniture hinge 2 is in the form of a wide-angle hinge having at least seven axes of rotation S1, S2, S3, S4, S5, S6 and S7, wherein the axis of rotation S6 lies within the hinge cup 4. The first joint lever 7*a* which is pivotally connected on the one hand by way of the axis of rotation S1 to the stationary hinge arm 3 and on the other hand to the movable intermediate portion 6 by way of the axis of rotation S2 is provided for acting on the displaceable slider 9. In FIG. 3*a* the joint lever 7*a* is spaced relative to the slider 9, whereby the rotation damper 10 mounted in or on the slider 9 or in or on the hinge arm 3 is initially not active.

It can be seen from FIG. 3*b* that, in the illustrated relative intermediate position of the hinge cup 4 with respect to the hinge arm 3, the joint lever 7*a* engages (contacts) the slider 9 whereby the damping process starts. In the further closing movement, the slider 9 is moved (pushed) relative to the hinge arm 3 into a rear end position by the joint lever 7*a*, as is shown in FIG. 3*c*. FIG. 3*c* therefore shows the furniture hinge 2 in the fully closed position. The rotation damper 10 (not visible here) is drivable by the triggered linear movement of the slider 9 so that the pivoting movement of the joint lever 7*a* (and therewith the closing movement of the furniture hinge 2) can take place in damped fashion. Starting from the completely closed position shown in FIG. 3*c* the furniture hinge 2 can be opened again, in which case the pivotable joint lever 7*a* immediately lifts off the slider 9 and the furniture hinge 2 is movable in the direction of the open position, in a manner in which it is uncoupled from the rotation damper 10. For returning the slider 9 into a position intended for the next damping stroke, there is a return mechanism (for example a return spring), by which the slider 9 can be moved back into a position as shown in FIG. 3*a* again. The slider 9 can possibly also have lateral projections (not shown) on which the joint lever 7*a* can act.

FIG. 4*a* shows a perspective view of the furniture hinge 2 in an open position. It is possible to see the two fitment parts in the form of the hinge arm 3 and the hinge cup 4. By virtue of the intermediate portion 6, it is possible for the two furniture parts 1*a*, 1*b* not only to be pivoted relative to each other, but to also increase their mutual spacing in the pivotal movement. For that purpose, starting from the closed position shown in FIG. 4*b*, the intermediate portion 6 is pivoted by the joint levers 7*a*, 7*b* beyond the hinge arm 3, and effectively prolongs the hinge arm into an open position, as shown in FIG. 4*a*. Thus, the two fitment parts 3, 4 are spaced at different distances from each other in the two end positions. FIG. 4*a* also shows the switching member 11 in a switching position in which the hinge movement takes place in damped relationship. In the course of the closing movement, the two lateral joint levers 7*a* meet (contact) the slider 9 and displace it rearwardly, so that a damping effect is generated in that case. In contrast, FIG. 4*b* shows the switching member 11 in a switching position in which the hinge movement takes place undamped. Accordingly, the user is therefore responsible for deciding whether a damping action on the furniture hinge 2 is or is not to be provided, by suitable actuation of the switching member 11.

FIGS. 5*a*-5*e* show various views of the linearly displaceable slider 9 and the switching member 11 for deactivation of the damping function of the rotation damper 10. In the illustrated embodiment, the slider 9 is also in the form of a housing for the rotation damper 10. FIG. 5*a* shows the slider 9 with the rotation damper 10 integrated therein, wherein a shaft 10*a* has a pinion 10*b* mounted thereon for driving the rotation damper 10. The switching knob 12 can be axially displaced along the shaft 10*a* by the switching member 11—which is not shown in FIG. 5*a*—, whereby the damping action can be deactivated. FIG. 5*b* shows a perspective view illustrating the underside of the hinge arm 3, showing the transmission mechanism T. Arranged on the hinge arm 3 is a stationary rack 10*c*, along which the pinion 10*b* can run when the slider 9 is acted upon by the joint lever 7*a*. It is possible to see a return mechanism 13 in the form of a torsion spring which is stressed during the damping stroke by the displacement of the slider 9. After damping has been effected, the pinion 10*b* is moved by the stored energy of the torsion spring in the opposite direction of rotation, whereby the slider 9 can also be moved back again into a ready position for the next damping stroke. The return mechanism 13 with the torsion spring is therefore operative between the slider 9 and the pinion 10*b*. In a mechanical reversal it is also possible for the rotation damper 10 with the pinion 10*b* to be arranged on the hinge arm 3 and the rack 10*c* on the movable slider 9.

FIG. 5*c* shows a perspective view of the switching member 11 from below, while FIG. 5*d* shows a plan view of the switching member 11. FIG. 5*e* shows a sectional view of the switching member 11 along the arrows in FIG. 5*d*. FIG. 5*e* shows an inclined sliding guide 11*a* for raising and lowering the switching knob 12 shown in FIG. 5*a*, wherein the damping function of the rotation damper 10 can be deactivated in a lowered position of the switching knob 12.

FIG. 6 shows the carcass-side part of the furniture hinge 2 as an exploded view. The furniture hinge 2 can be releasably latched by way of a plate holder 14 to a mounting plate 5 as shown in FIG. 2. The relative position of the hinge arm 3 with respect to the plate holder 14 can be variably adjustable by way of a depth adjusting device 15*a* and by way of a height adjusting device 15*b*. The drawing also shows the rack 10*c* arranged stationarily on the hinge arm 3 and provided for meshing with the pinion 10*b* of the rotation damper 10. The return mechanism 13 in the form of the torsion spring serves for rotating the pinion 10*b* back again, whereby the slider 9 is also movable back into a starting position for the next damping stroke again. Mounted on the shaft 10*a* is a rotatable damping component 16 which, in the mounting position, is arranged rotatably relative to the slider 9. A shearing gap with a damping fluid is operative between the damping component 16 and the slider 9. The rotation damper 10 also includes a freewheel clutch 20 with a cage 20*a* rotatable by the switching member 11, wherein a damping function of the furniture hinge 2 is provided in a first switching position of the switching member 11 and the damping function is deactivated in a second switching position of the switching member 11. That is controlled by the switching member 11 which moves the switching knob 12 downwardly by way of the sliding guide 11*a* shown in FIG. 5*e*, whereby the cage 20*a* is rotated. Thereby, the damping component 16 is uncoupled from the rotary movement of the shaft 10*a*. The intermediate portion 6 is connected to the hinge arm 3 by way of the first joint lever 7*a*. The joint lever 7*a* serves, on the one hand, for acting on the slider 9 and, on the other hand, for connecting the intermediate portion 6 to the hinge arm 3. FIGS. 7*a* and 7*b* show a very simple structure for deactivation of the damping function of the rotation damper 10. Axial displacement of the shaft 10*a* with the pinion 10*b* arranged thereon is possible by way of a displacement of the switching member 11 (FIG. 6) so that the pinion 10*b* is moved out of the rack 10*c*. The uncoupled position of the pinion 10*b* is shown in FIG. 7*a*, in which case the hinge movement can take place in undamped fashion. In FIG. 10*b*, in contrast, the switching member 11 is set so that the pinion 10*b* is in engagement with the rack 10*c*, whereby a hinge movement can be damped.

FIGS. 8*a* and 8*b* show a further possible way of deactivating the damping function of the rotation damper 10. The illustrated Figures show perspective vertical sections of the slider 9 with the rotation damper 10 arranged therein. It is possible to see the shaft 10*a* drivable by the pinion 10*b* as well as the damping component 16 arranged rotatably within the slider 9, wherein an annular shearing gap 18 for receiving a damping fluid remains between the damping component 16 and the slider 9. In FIG. 8*a*, the switching member 11 is in a deactivating switching position in which the damping function of the rotation damper 10 is deactivated. At least one clamping body 19 is controllable in the peripheral direction of the shaft 10*a* by the switching member 11, the clamping body 19 selectively coupling the damping component 16 to the movement of the shaft 10*a*. The clamping body 19 has been raised out of the plane of the section, for the sake of improved clarity. In FIG. 8*a*, the clamping body 19 therefore does not form a clamping connection between the shaft 10*a* and the damping component 16, whereby no relative movement of the damping component 16 with respect to the outer slider 9 also takes place. The hinge movement therefore takes place undamped.

In FIG. 8*b*, in contrast, the switching member 11 has been moved into a damping switching position, whereby the clamping body 19 now forms a clamping connection between the shaft 10*a* and the damping component 16. When now the shaft 10*a* is moved by way of the pinion 10*b*, the damping component 16 is also moved with the shaft 10*a* by virtue of the clamping connection. Thus, there is a relative movement between the damping component 16 and the outer slider 9, that movement being braked by the damping fluid arranged in the shearing gap 18.

Figure 9A:
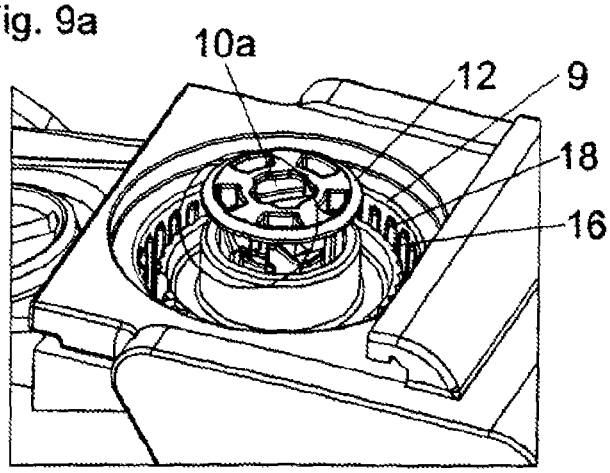
Figure 9B:
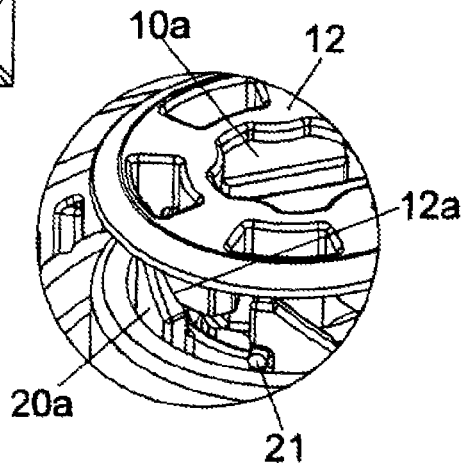

FIGS. 9*a*-9*d* show various views of the switching knob 12 which is adjustable in respect of height by displacement of the switching member 11 by way of the sliding guide 11*a* (FIG. 5*e*). FIG. 9*a* shows the central shaft 10*a* with the damping component 16 which can be coupled thereto, an annular shearing gap 18 for receiving the damping fluid remaining between the damping component 16 and the slider 9. FIG. 9*a* shows the raised position of the switching knob 12 so that the damping function is deactivated. FIG. 9*b* shows a detail view on an enlarged scale of the region circled in FIG. 9*a*. In FIG. 9*b* the switching knob 12 has inclined surfaces 12*a* arranged thereon, which can cooperate with corresponding inclined surfaces of a cage 20*a* surrounding the shaft 10*a*.

Figure 9C:
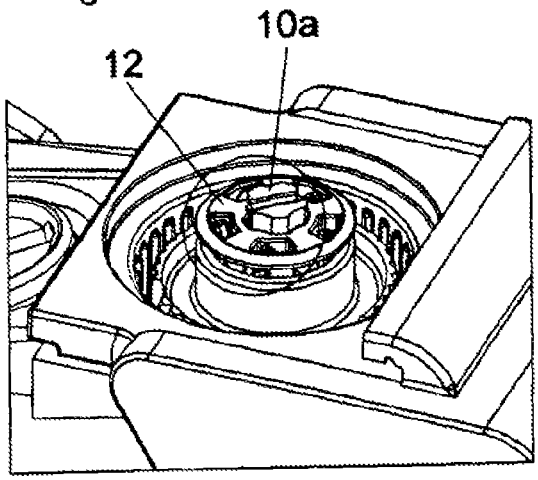
Figure 9D:
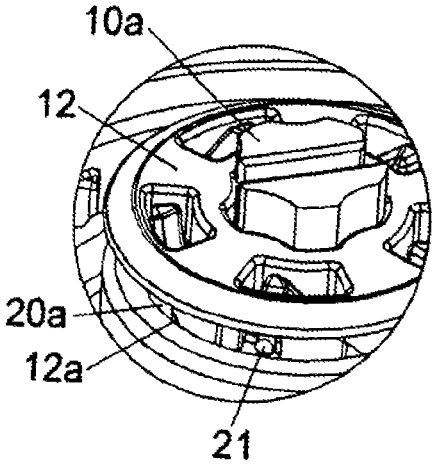

The switching knob 12 can only be moved axially relative to the shaft 10*a* by virtue of the non-circular cross-section. In the case of a purely axial movement of the switching knob 12 relative to the shaft 10, the case 20*a* is consequently rotatable in the peripheral direction of the shaft 10*a*. That situation is shown in FIG. 9*c* and in particular in the detail view of FIG. 9*d*. The cage 20*a* is rotatable by a downward movement of the switching knob 12—caused by displacement of the switching member 11—, whereby the clamping bodies 19 (not visible here) couple the damping component 16 to the shaft 10*a* so that therefore the damping component 16 is also rotated with the shaft 10*a*. That rotation of the damping component 16, however, is braked by the damping fluid in the shearing gap 18 so that the hinge movement can also be braked thereby. A spring 21 is provided for acting on the cage 20*a* or the clamping body 19 in the direction of the freewheel position.

Figure 10A:
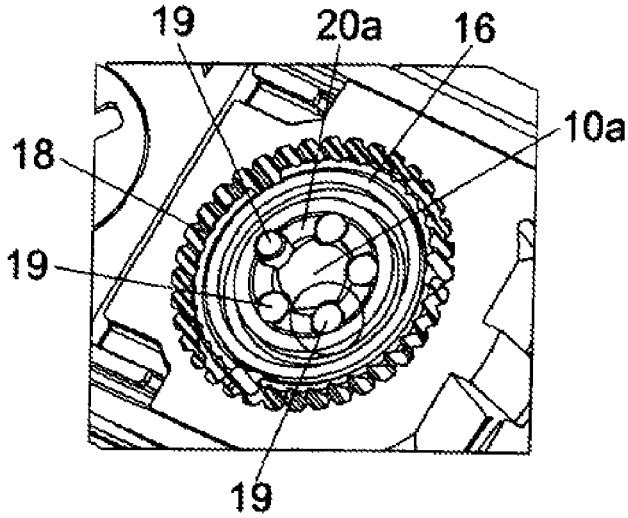
Figure 10B:
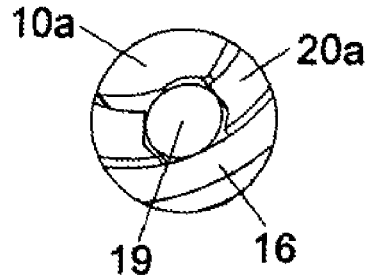
Figure 10C:
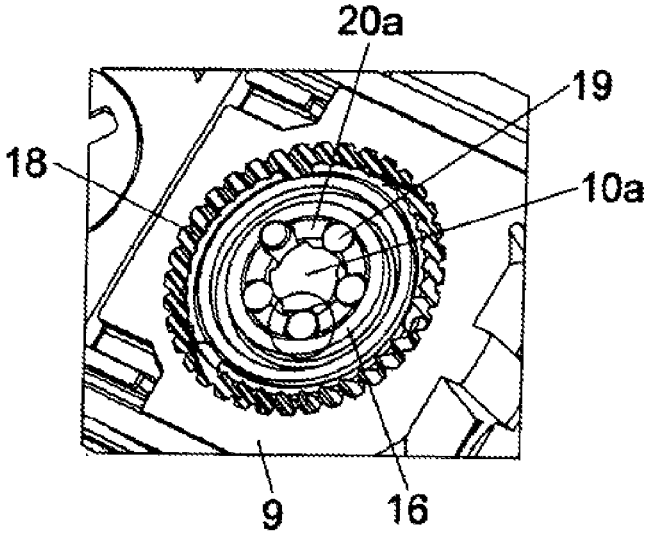
Figure 10D:
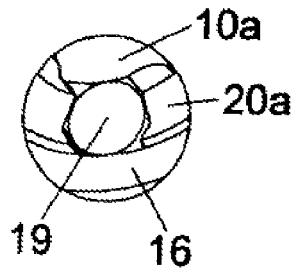

FIG. 10*a* shows the shaft 10*a* with the surrounding clamping bodies 19 which selectively couple the rotatable damping component 16 to the rotary movement of the shaft 10*a*, or not. It is possible to see the cage 20*a* (FIGS. 9*a* through 9*c*) which is displaceable by a movement of the switching member 11 and by way of the switching knob 12 in the peripheral direction of the shaft 10*a*. FIG. 10*a* and the enlarged detail view in FIG. 10*b* do not involve a damping function as the clamping bodies 19 respectively come to lie in recesses in the shaft 10*a*, whereby a rotary movement of the shaft 10*a* is not transmitted to the damping component 16. In FIG. 10*c*, in contrast the cage 20*a* has been displaced by the switching member 11 in the peripheral direction of the shaft 10*a* so that the clamping bodies 19 are moved out of the recesses in the shaft 10*a* and now come to bear against inclined surfaces of the shaft 10*a*, whereby therefore a clamping connection can be made between the shaft 10*a* and the rotatable damping component 16. When, therefore, the shaft 10*a* is rotated by way of the pinion 10*b*, the damping component 16 is also rotated by virtue of the force-locking coupling by the switchable clamping bodies 19. It will be noted however that that movement is damped by the damping fluid in the shearing gap 18.

The width of the slider 9 is preferably greater than that of the hinge arm 3, and the slider 9 can be movable relative to the hinge arm 3 by way of linear sliding guides. It will be appreciated that it is also possible to move the slider 9 relative to the hinge arm 3 by way of guide elements which can be guided in or along straight or also curved guide paths. In the illustrated embodiments the slider 9 is mounted slidingly at an outside of the hinge arm 3. The shaft 10*a* of the rotation damper 10 can be arranged transversely, preferably at a right angle, to a longitudinal axis of the hinge arm 3 and substantially parallel to a vertical plane in relation to that longitudinal axis.

The present invention is not limited to the illustrated embodiments, and includes or extends to all variants and technical equivalents which can fall within the scope of the claims appended hereto. The positional references adopted in the description such as for example up, down, lateral and so forth are also related to the usual installation position of the furniture hinge 2 or the directly described and illustrated Figure and upon a change in position are to be appropriately transferred to the new position.

The invention claimed is:

1. A furniture hinge comprising at least two fitment parts to be fixed to respective furniture parts, a first one of said fitment parts being a hinge arm;

a pivotable first joint lever;

a pivotable second joint lever;

an intermediate portion coupled to said hinge arm via said first joint lever and said second joint lever, said first joint lever and said second joint lever being pivotally mounted between said intermediate portion and to said hinge arm;

a rotation damper for damping a closing hinge movement;

a slider mounted displaceably on said hinge arm, at least one of said first joint lever and said second joint lever being configured for acting on and driving said slider during the closing hinge movement; and a transmission mechanism for transmitting motion of said slider to said rotation damper.

2. The furniture hinge according to claim 1, wherein said rotation damper is mounted at an end of said hinge arm, said end being remote from a second one of said fitment parts.

3. The furniture hinge according to claim 1, wherein said slider is linearly movably mounted to said hinge arm, and said slider is displaceable relative to said hinge arm at least during a damping stroke.

4. The furniture hinge according to claim 1, wherein said slider is separate from each of said first joint lever and said second joint lever, and said slider is configured so as to be acted upon by at least one of said first joint lever and said second joint lever only in a predetermined relative position of said at least two fitment parts with respect to each other.

5. The furniture hinge according to claim 1, wherein said transmission mechanism is configured for converting a pivotal movement of said at least one of said first joint lever and said second joint lever into a rotary movement of said rotation damper.

6. The furniture hinge according to claim 1, wherein said transmission mechanism comprises a rack-and-pinion arrangement.

7. The furniture hinge according to claim 6, wherein said rotation damper is mounted to said slider, and a rack of said rack-and-pinion arrangement is mounted to said hinge arm.

8. The furniture hinge according to claim 6, wherein said rotation damper is mounted to said hinge arm, and a rack of said rack-and-pinion arrangement is mounted to said slider.

9. The furniture hinge according claim 1, wherein said rotation damper includes a plurality of components, all of said components of said rotation damper move during a damping stroke relative to both of said at least two fitment parts.

10. The furniture hinge according to claim 1, further comprising a return mechanism for moving said slider back into a start position to begin a subsequent damping stroke after damping has occurred.

11. The furniture hinge according to claim 1, wherein said hinge has at least seven rotatable axes.

12. The furniture hinge according to claim 1, wherein said at least two fitment parts, said first joint lever, said second joint lever, said intermediate portion, and said slider are configured so that a maximum opening angle between said fitment parts is at least 170°.

13. The furniture hinge according to claim 1, further comprising a switching member for activating and deactivating a damping action of said rotation damper.

14. The furniture hinge according to claim 13, wherein said switching member is manually actuatable.

15. The furniture hinge according to claim 13, wherein said switching member has a first switching position and a second switching position, said switching member being configured to ensure damping in the first switching position and to deactivate damping in the second switching position.

16. The furniture hinge according to claim 15, wherein said switching member is mounted to said slider, and said switching member is linearly displaceable between the first switching position and the second switching position.

17. An article of furniture comprising:

a first furniture piece;

a second furniture piece; and a furniture hinge connecting said first furniture piece and said second furniture piece, said furniture hinge including:

at least two fitment parts to be fixed to a respective one of said first furniture piece and said second furniture piece, a first one of said fitment parts being a hinge arm;

a pivotable first joint lever;

a pivotable second joint lever;

an intermediate portion coupled to said hinge arm via said first joint lever and said second joint lever, said first joint lever and said second joint lever being pivotally mounted between said intermediate portion and to said hinge arm;

a rotation damper for damping a closing hinge movement;

a slider mounted displaceably on said hinge arm, at least one of said first joint lever and said second joint lever being configured for acting on and driving said slider during the closing hinge movement; and a transmission mechanism for transmitting motion of said slider to said rotation damper.

* * * * *